US005224548A

United States Patent [19]

Dankovich, II

[11] Patent Number: 5,224,548

[45] Date of Patent: Jul. 6, 1993

[54] APPARATUS AND METHOD FOR RETRIEVING LOST MATERIALS IN SLANTED BOREHOLES

[76] Inventor: Kalman E. Dankovich, II, 461 Liberty St., Grove City, Pa. 16127

[21] Appl. No.: 814,092

[22] Filed: Dec. 26, 1991

[51] Int. Cl.[5] ..... E21B 21/00

[52] U.S. Cl. ..... 166/311; 166/99; 175/310

[58] Field of Search ..... 166/99, 66.4, 82, 242; 175/61, 310, 323, 328, 394

[56] References Cited

U.S. PATENT DOCUMENTS

| | | | |
|---|---|---|---|
| 183,467 | 10/1876 | Pierce | 175/394 |
| 1,305,792 | 6/1919 | Fraser | 175/394 |
| 1,604,722 | 10/1926 | Rotinoff | 175/394 |
| 2,946,567 | 7/1960 | Pepper | 175/323 |
| 3,232,361 | 2/1966 | Haspert | 175/310 |
| 3,378,089 | 4/1968 | Marsh | 175/328 |
| 3,690,388 | 9/1972 | Hilton et al. | 175/20 |
| 3,900,074 | 8/1975 | Lee | 175/242 |
| 5,067,570 | 11/1991 | Gilcrease | 175/310 |
| 5,076,355 | 12/1991 | Donovan et al. | 166/242 |

*Primary Examiner*—Ramon S. Britts
*Assistant Examiner*—Frank S. Tsay
*Attorney, Agent, or Firm*—Honigman Miller Schwartz and Cohn

[57] ABSTRACT

A method and apparatus are disclosed for clearing debris and for retrieving lost materials from slanted boreholes. The apparatus has a central shank which is attachable to drill pipe and an auger-like helical plate wound around the shank. A cylinder with a back plate and partial front plate encloses the helical plate. In practicing the method, debris is cleared and lost materials are retrieved from a slanted borehole by rotation of an auger-like apparatus, preferably the apparatus of the invention, along the path of the borehole.

9 Claims, 3 Drawing Sheets

APPARATUS AND METHOD FOR RETRIEVING LOST MATERIALS IN SLANTED BOREHOLES

FIELD OF THE INVENTION

This invention relates to apparatuses and methods for clearing debris and retrieving lost materials from boreholes, particularly horizontal directional boreholes for pipelines and directional or horizontal wells for oil or gas production.

BACKGROUND OF THE INVENTION

In the art of boring subterranean boreholes for pipelines, such as pipelines used in the underground transportation of natural gas, debris and any lost or foreign materials in the borehole should be removed prior to installation of the pipeline. Such boreholes, typically called "directional horizontal" boreholes, are substantially horizontal and are drilled in a particular direction toward a certain destination, in contrast to vertical boreholes deadening into the subterranean formation as typical for boreholes for oil and gas production wells.

The substantially horizontal position of boreholes for pipelines makes removing debris and lost materials from the boreholes difficult, costly, and time consuming, to an extent even greater than is common for retrieving lost materials from oil and gas wells. Tools for this purpose, commonly "fishing" tools borrowed from the oil and gas well drilling industry, typically depend on powerful magnets to recover the lost materials. Debris in pipeline boreholes, however, is not always comprised of metal that may be attracted by such magnets. Moreover, even if the debris is comprised of metal that might be attracted by the magnet, the forces of gravity pull against the forces of the magnet in a horizontal well, making such traditional tools less effective.

These problems with the traditional fishing tools have been noted as well in their use or attempted use to retrieve lost materials in slanted or horizontal boreholes drilled for oil and gas production wells.

In the art of drilling boreholes in hydrocarbon bearing formations to facilitate production of hydrocarbons from such formations, occasions sometimes arise that make it necessary or advantageous to drill at an angle or slanted direction rather than in a typical vertical direction. For example, slanting the lower end of a wellbore substantially horizontally so that it penetrates the "pay zone," or part of the formation to be produced, allows a greater number of perforations into that pay zone from that wellbore. This enables faster production from the formation.

Slanting a wellbore substantially horizontally and at considerable distance radially away from the drilling rig also enables the pay zone to be entered at a number of different locations radially spaced about the drilling rig so that a plurality of wellbores can be drilled from a common drilling location. This technique is especially advantageous when the cost of moving the drilling rig is considerable, as is often the case in offshore drilling.

Such drilling at an angle or slant, called "directional drilling," is also used when locating a drilling rig directly over the desired site is impractical or impossible because of a river, hill, or some other obstruction.

Sometimes while drilling such a well, drill bits or other tools may become lost in the wellbore. The cost of such tools and/or their interference with further drilling may make it desirable or essentially necessary to recover the lost tools.

New and improved tools and methods are needed for clearing debris and removing lost materials from slanted boreholes in the oil and gas well drilling industry and horizontal directional boreholes in the pipeline industry.

SUMMARY OF THE INVENTION

The apparatus of this invention is particularly suited to retrieving materials from a slanted borehole. The apparatus has a shank connectable to drill pipe and around which is wound a helical plate. A cylinder encloses the helical plate. The cylinder has a back plate on it posterior end and a partial front plate on its anterior end. A means is provided for rotating the helical plate. The cylinder will preferably rotate along with the helical plate.

The method of this invention employs an auger-type tool to retrieve a lost material from a borehole. The tool has a rotatable helix about a shank inside a cylinder. The preferred tool for use in the method is the apparatus of this invention.

In practicing the method of this invention, an auger-like tool is attached to drill pipe and lowered into the borehole. The tool, or at least the helix portion of the tool, is rotated along the path of the borehole. As the tool rotates along such path, the material to be retrieved on such path is collected by the tool. The collected material may then be removed.

DESCRIPTION OF THE PREFERRED EMBODIMENT

I have found an apparatus and method for retrieving materials and clearing debris from a slanted borehole. The term "slanted wellbore" or "slanted borehole" as used herein refers to a wellbore or borehole which deviates or is sloped away from a vertical position. The term includes but is not limited to horizontal directional boreholes, such as those created for pipelines, and substantially horizontal wells for oil and gas production.

Materials the apparatus and method are particularly suited for retrieving include debris from boring the hole and tools lost in the wellbore, such as, for example, drill bits or other parts of a drilling assembly, and small nondrillable pieces or matter commonly known in the oil and gas industry as "junk."

The apparatus and method have particular application in the boring of horizontal directional boreholes for pipelines and in the drilling of slanted oil and gas wells, although they may be used in any slanted borehole or wellbore.

Figure 3:
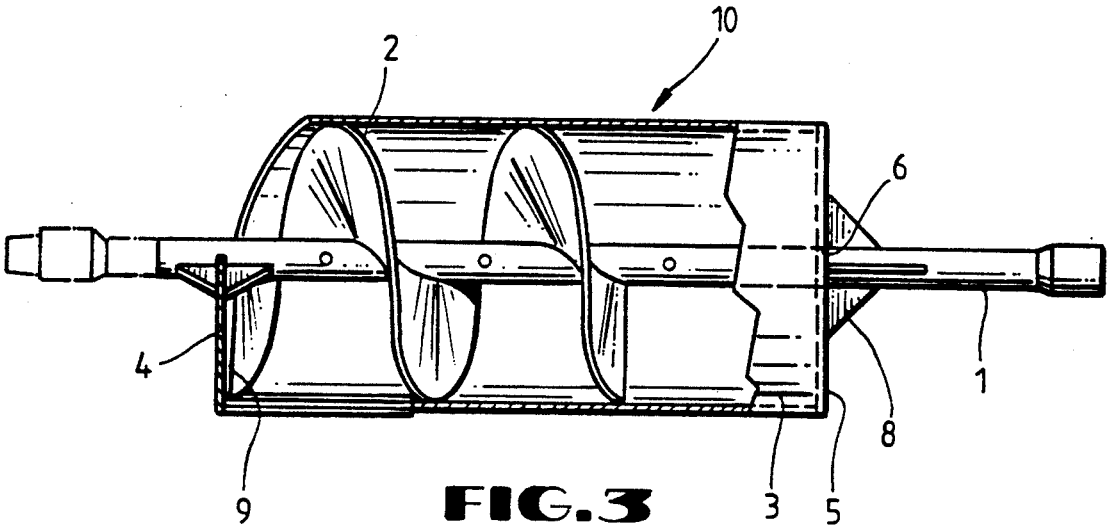
FIG. 3 is a side view of the apparatus of this invention, with the cylinder cut away, showing the auger flighting and shaft.
Figure 4:
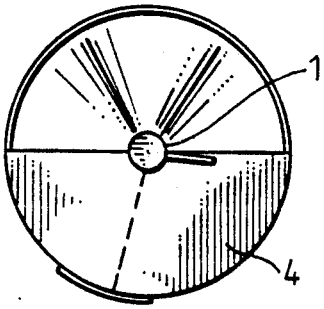
FIG. 4 is a frontal view of the front plate.
Figure 6:
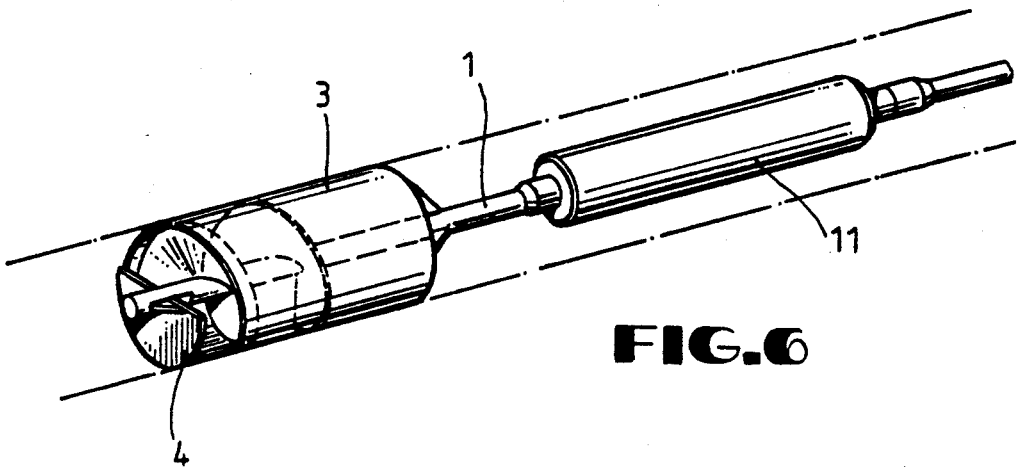
FIG. 6 is an angular side view of the apparatus of this invention attached to drill pipe.

Referring to FIG. 3, the apparatus 10 of this invention has a shaft 1 around or about which a plate or auger flighting 2 is helically coiled. The shaft is adapted on at least one end for connection to a drill pipe 11, as illustrated in FIG. 6. As used herein, the term "drill pipe" includes any means for holding and extending the apparatus into a borehole. The term includes "drill pipe" as the term is traditionally used in the oil and gas industry but it also include other pipes or connectors or lines capable of carrying the apparatus of this invention into a wellbore. The apparatus, or at least the plate or auger flighting 2, is rotatable and either achieves such rotation via connection to and with rotation of the drill pipe 11 or via a separate rotator or other means for causing such rotation.

A cylinder 3 surrounds or encloses the helical plate or auger flighting 2, as shown in FIG. 6. The external diameter of the cylinder 3 should be such as to fit into the borehole in which the apparatus is to be used. Typically in the pipeline industry, boreholes range in size from about 10 inches in diameter to about 42 inches in diameter. The diameter of the cylinder 3 will preferably be such as to touch or nearly touch the outer edges of the helical plate or auger flighting 2.

Figure 2:
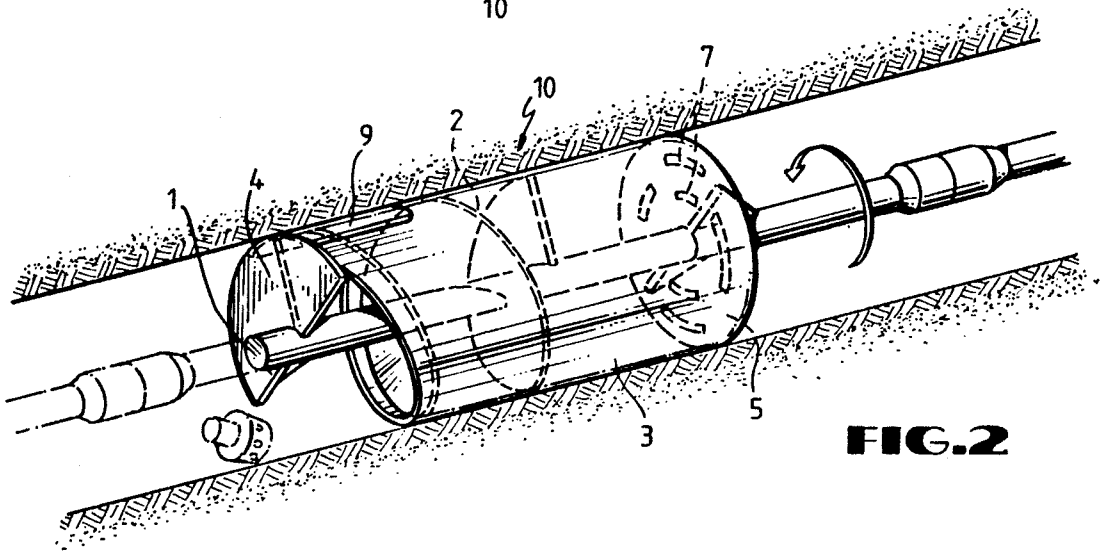
FIG. 2 is an enlargement of the apparatus in operation in FIG. 1, with the cylinder cut away showing the auger flighting and shaft and direction of rotation of the apparatus.
Figure 5:
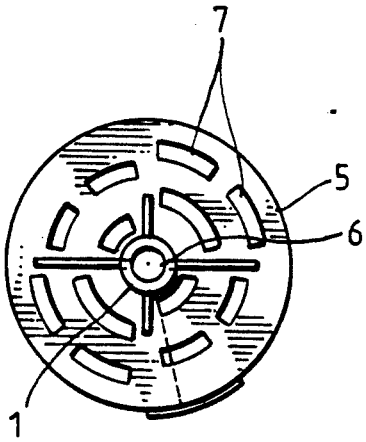
FIG. 5 is an end view of the back plate showing slots to allow for exit of mud, drill cuttings, and dirt.

Attached to one end of the cylinder 3 is a back plate 5 which has an opening 6 for the shaft 1 to extend through and has other slits or holes 7 spaced about its face which otherwise preferably covers the entire end of the cylinder, as shown in FIGS. 2 and 5. The slits or holes should be smaller than any material the tool may be desired to retrieve but sufficiently large and numerous enough in quantity to allow mud and dirt in the borehole to pass through. This will prevent filling of the cylinder with mud and dirt hampering collection of the material desired to be retrieved. Preferably a magnet is attached to the interior side of the back plate to assist in holding various metal materials that may be desired to be retrieved.

Supports or braces 8 preferably brace the back plate and attach it to the shaft 1, as illustrated in FIG. 3. Such supports 8 may be removable or adjustable so that the back plate can be moved away from the cylinder if desired, to ease cleaning of the apparatus and to ease removal of any trapped materials from the apparatus. Alternatively, the back plate 5 may be welded or otherwise permanently attached to the cylinder or attached to the cylinder with braces, bolts or other holders separately from the connectors attaching the cylinder to the shaft.

Attached to the other end of the cylinder 3 is a front plate 4 that covers only a portion, preferably about half, of that end, as depicted in FIGS. 2, 3, and 6. The front plate has an opening or is curved around the shaft 1 so the shaft may extend through the plate or out of the cylinder without interference from the plate. The front plate 4 is preferably reinforced with a reinforcing plate 9, as shown in FIG. 3.

The apparatus may be comprised of any material typically used for downhole tools or auger flighting, for example, metals such as steel or aluminum or various metallic alloys or even high strength plastics.

In operation, the apparatus preferably collects material into the anterior end of the cylinder and, as the apparatus rotates, passes the material along the path of the helical plate to the posterior end of the cylinder where the material becomes deposited against the back plate to await retrieval. Such retrieval is preferably accomplished by reverse rotating the apparatus or at least the helical plate or by removing the back plate and lifting the material from the apparatus. However, alternative means for removal of the collected material from the apparatus may be used, such as, for example, flushing the apparatus with water or manually removing the material from the apparatus.

In practicing the method of this invention, an auger-like tool with a helical or spiral plate wrapped about a shaft is attached to a drill string, as shown in FIGS. 1, 2, 6 and 7. The tool should have a means for holding materials collected by the tool as the helical plate turns without collecting substantial amounts of mud, drill cuttings, and dirt from the well. For example, the tool might have a back plate or a magnet to hold material to be retrieved and outlets for the mud, drill cuttings, and dirt. A preferred tool for practicing the method of the invention is the apparatus 10 of this invention.

Figure 1:
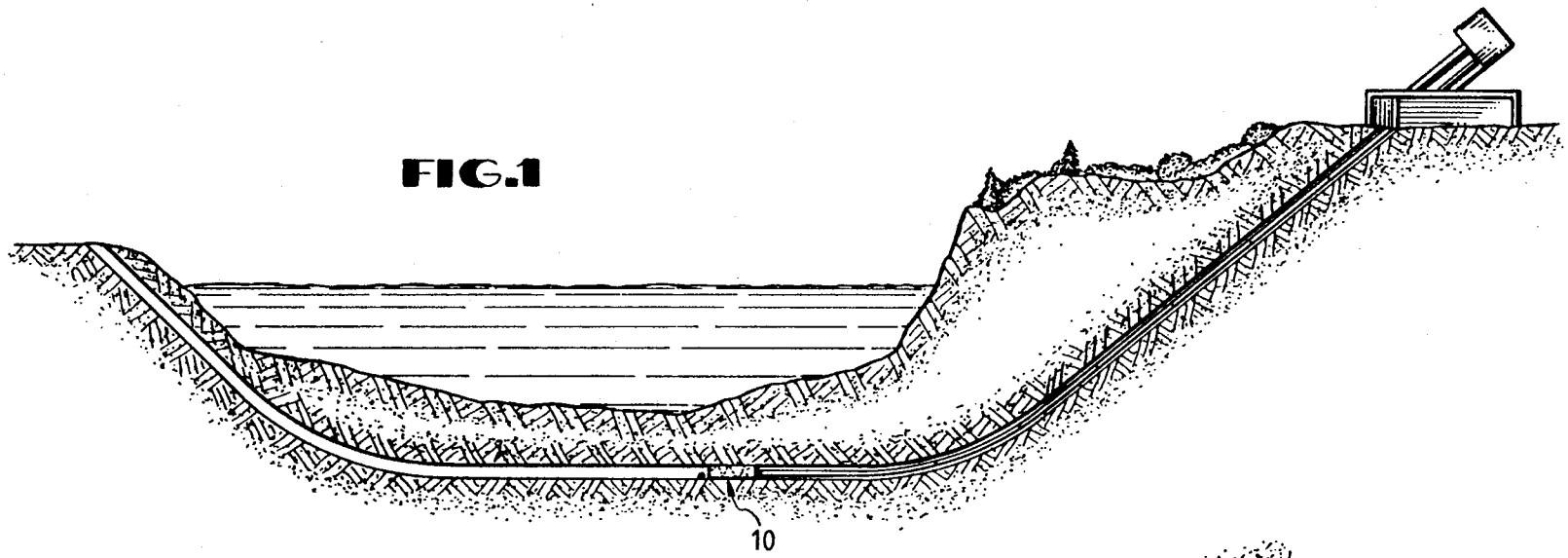
FIG. 1 is a schematic of the apparatus of this invention in operation in a horizontal directional pipeline borehole according to the method of this invention.
Figure 7:
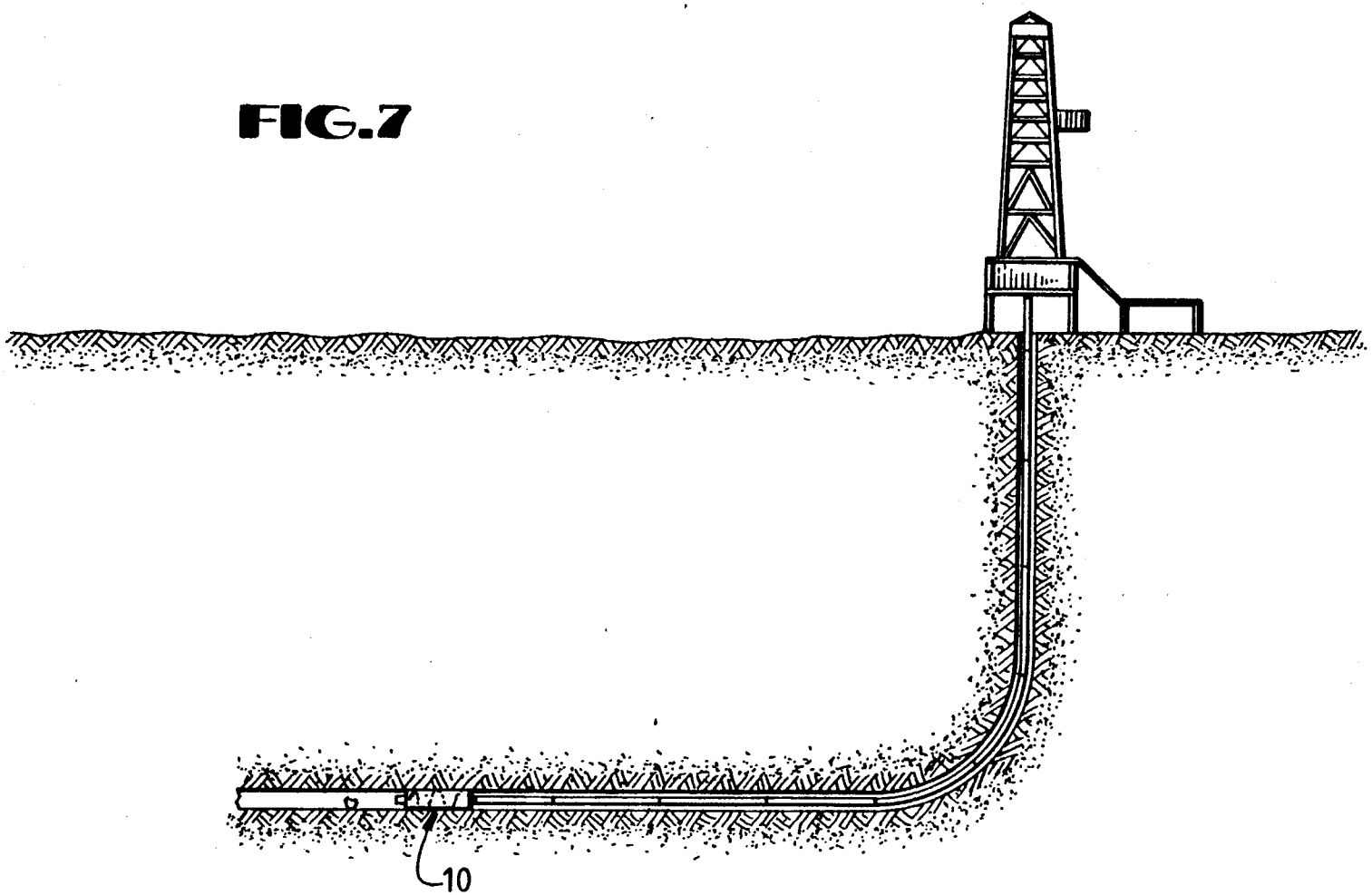
FIG. 7 is a schematic of the apparatus of this invention in operation in a substantially horizontal wellbore according to the method of this invention.

After attaching the auger-like tool to the drill string with means for rotating the tool, or at least with means for rotating the auger-like helical plate portion of the tool, the tool is lowered into the wellbore. Referring to FIGS. 1, 2 and 7, the tool is rotated as it passes along the slanted path of the well to search for material to be retrieved, such as a missing tool or junk interfering with drilling of the well. As the auger-like tool turns, or particularly as the helical plate turns, such material to be retrieved is pulled into the tool and guided along the helical path of the helical plate until the material reaches the part of the tool for holding the material, such as a back plate or magnet.

The tool is then brought to the surface of the well and the retrieved material is removed from the tool. Such removal may be facilitated, for example, by reverse rotation of the tool or by removal of the back plate, magnet or other collector or holding portion of the tool.

It will be apparent that various changes may be made in the details of construction of the apparatus and the details of the performance of the method from those shown in the attached drawings and discussed in conjunction therewith without departing from the spirit and scope of this invention as defined in the appended claims. It is therefore to be understood that this invention is not to be limited to the specific details shown and described.

I claim:

1. An apparatus for selectively retrieving materials from a slanted borehole, comprising:

(a) a shank, adapted at its posterior end for threaded connection to a drill pipe, whereby the apparatus can be run downhole and into the slanted borehole;

(b) a plate wound helically about the shank;

(c) drill means for connecting to the drill pipe and rotating said helical plate;

(d) a cylinder enclosing said helical plate with a back plate on the posterior end of the cylinder and a partial front plate on the anterior end of the cylinder; and (e) the back plate having multiple outlets for selectively retrieving materials from the slanted borehole.

2. The apparatus of claim 1 wherein the shank is adapted at its anterior end as well as its posterior end for threaded connection to drill pipe.

3. The apparatus of claim 1 further comprising a reinforcement plate at the anterior end of the cylinder.

4. The apparatus of claim 1 further comprising a magnet adjacent said back plate.

5. The apparatus of claim 1, wherein said back plate has multiple outlets smaller in diameter than the materials to be retrieved.

6. A method for clearing debris from a horizontal borehole, comprising the steps of:

(a) attaching an auger-type tool to a drill pipe, the auger-type tool including a rotatable helix about a shank inside a cylinder;

(b) extending the drill pipe with the attached auger-type tool into the horizontal borehole;

(c) rotating the helix along the path of the horizontal borehole;

(d) selectively collecting debris in the path of the borehole;

(e) holding the collected debris in the auger-type tool; and (f) removing the auger-type tool from the borehole.

7. A method for retrieving a lost material from a slanted borehole, comprising the steps of:

(a) attaching an auger-type tool to a drill pipe, the auger-type tool including a rotatable helix about a shank inside a cylinder;

(b) rotating the drill pipe with the attached auger-type tool into the borehole;

(c) rotating the helix and selectively collecting lost material from the slanted borehole; and (d) retrieving the collected lost material in the auger-type tool.

8. The method of claim 7 wherein said lost material is a portion of the drilling assembly.

9. The method of claim 7 wherein said collected material is removed by reverse rotation of the helix.

* * * * *

UNITED STATES PATENT AND TRADEMARK OFFICE

CERTIFICATE OF CORRECTION

PATENT NO. : 5,224,548

DATED : July 6, 1993

INVENTOR(S) : Kalman E. Dankovich II

It is certified that error appears in the above-indentified patent and that said Letters Patent is hereby corrected as shown below:

Column 1, line 22, "deadening" should be -- deadending --.

Signed and Sealed this

Twenty-ninth Day of March, 1994

Bruce Lehman

*Attest:*

BRUCE LEHMAN

*Attesting Officer*

*Commissioner of Patents and Trademarks*